US011384542B2

(12) United States Patent
DeRogatis et al.

(10) Patent No.: US 11,384,542 B2
(45) Date of Patent: Jul. 12, 2022

(54) ROOF SHINGLE TILE AND METHOD OF INSTALLING THE SAME

(71) Applicant: PLY GEM INDUSTRIES, INC., Cary, NC (US)

(72) Inventors: Dave DeRogatis, Cary, NC (US); Jake Allen, Gardner, KS (US); Kaleb Hahn, Kansas City, MO (US)

(73) Assignee: PLY GEM INDUSTRIES, INC., Cary, NC (US)

( * ) Notice: Subject to any disclaimer, the term of this patent is extended or adjusted under 35 U.S.C. 154(b) by 0 days.

(21) Appl. No.: 16/833,462

(22) Filed: Mar. 27, 2020

(65) Prior Publication Data

US 2020/0318353 A1 Oct. 8, 2020

Related U.S. Application Data

(60) Provisional application No. 62/825,364, filed on Mar. 28, 2019.

(51) Int. Cl.

| | |
|---|---|
| ***E04D 1/08*** | (2006.01) |
| ***E04D 1/00*** | (2006.01) |
| *E04D 1/34* | (2006.01) |

(52) U.S. Cl.

CPC ..... *E04D 1/2956* (2019.08); *E04D 1/08* (2013.01); *E04D 1/2949* (2019.08); (Continued)

(58) Field of Classification Search

CPC .... E04D 1/08; E04D 1/20; E04D 1/23; E04D 1/2949; E04D 1/2956; E04D 1/2984; (Continued)

(56) References Cited

U.S. PATENT DOCUMENTS 2,028,228 A * 1/1936 Ludowici ..... E04D 1/2916 52/536
2,482,835 A * 9/1949 Bremer ..... E04D 1/2916 52/553

(Continued)

FOREIGN PATENT DOCUMENTS

EP 2617914 A1 * 7/2013 ..... E04D 1/18
EP 3056629 A1 * 8/2016 ..... E04D 1/34

(Continued)

OTHER PUBLICATIONS

KR 10-2018-0017574 Machine Translation; http://engpat.kipris.or.kr/pmt/patent/patentRTT.jsp; Nov. 12, 2021 (Year: 2021).*

*Primary Examiner* — Ryan D Kwiecinski
(74) *Attorney, Agent, or Firm* — Williams Mullen; Andrew R. Shores

(57) ABSTRACT

A novel roof shingle tile and method of installation is presented. The roof shingle may include a first side opposite a second side, a top edge opposite a bottom groove, a top gutter, and a side gutter. The bottom groove may extend along a bottom edge of the tile that includes a bottom edge of the side gutter, and the top edge may include a tongue portion sized to fit within the bottom groove of a vertically adjacent tile. The second side may also include an overhang portion sized to overlap the side gutter of a horizontally adjacent tile. When installed, the shingle tiles may create a water resistant roof surface.

19 Claims, 8 Drawing Sheets

(52) U.S. Cl.
CPC ..... *E04D 2001/3423* (2013.01); *E04D 2001/3426* (2013.01); *E04D 2001/3458* (2013.01)

(58) Field of Classification Search
CPC ..... E04D 1/30; E04D 2001/3423; E04D 2001/3458; E04D 2001/3494; E04D 2001/3426
See application file for complete search history.

(56) References Cited

U.S. PATENT DOCUMENTS 2,664,056 A * 12/1953 Ronzone ..... E04D 1/06 52/526
2,766,706 A * 10/1956 Ludowici ..... E04D 1/04 52/533
3,835,609 A * 9/1974 Oscar ..... E04D 1/34 52/522
4,418,505 A * 12/1983 Thompson ..... E04D 12/00 52/95
D281,908 S * 12/1985 Olsson ..... D25/140
4,706,421 A * 11/1987 Thompson ..... E04D 13/1585 52/95
5,249,402 A * 10/1993 Crick ..... E04D 1/2916 52/553
5,613,337 A * 3/1997 Plath ..... E04D 1/265 52/529
5,642,596 A * 7/1997 Waddington ..... E04D 12/004 52/550
6,298,626 B2 10/2001 Rudden
RE38,210 E 8/2003 Plath et al.
6,983,571 B2 1/2006 Felton
7,140,153 B1 11/2006 Humphreys et al.
7,331,150 B2 2/2008 Martinique
7,520,098 B1 4/2009 Martinique et al.
7,563,478 B1 7/2009 Humphreys et al.
7,607,271 B2 * 10/2009 Griffin ..... E04D 3/355 52/535
7,712,277 B2 5/2010 Swanson
7,735,287 B2 6/2010 Gaudreau
7,845,141 B2 12/2010 Martinique
8,209,938 B2 7/2012 Gaudreau et al.
8,359,804 B2 * 1/2013 Wakefield ..... E04D 1/20 52/526
8,590,270 B2 11/2013 Martinique
8,671,639 B2 3/2014 Stanger
8,695,303 B2 4/2014 Swanson
8,713,861 B2 * 5/2014 Desloover ..... H02S 20/25 52/173.3
8,898,977 B2 12/2014 Francesco
9,109,363 B2 8/2015 Grau
9,267,296 B2 * 2/2016 Maurer ..... E04D 1/2916
9,523,202 B2 12/2016 Anderson et al.
9,605,432 B1 3/2017 Robbins
9,970,197 B2 * 5/2018 Maurer ..... E04F 13/0869
10,822,800 B2 * 11/2020 Kraft ..... E04D 1/265
2005/0252140 A1 11/2005 Faulkner et al.
2009/0007516 A1 1/2009 Swanson
2009/0031660 A1 2/2009 Faulkner et al.
2010/0011691 A1 1/2010 Anaya
2012/0085053 A1 4/2012 Barone
2013/0031864 A1 2/2013 Schools et al.
2014/0215945 A1 8/2014 Swanson
2014/0237915 A1 8/2014 Desloover
2015/0354217 A1 * 12/2015 Lucas ..... E04D 1/30 52/747.1
2015/0354224 A1 12/2015 Maurer et al.
2016/0040436 A1 2/2016 Grau
2017/0234017 A1 8/2017 Culpepper et al.
2017/0234019 A1 8/2017 Culpepper et al.
2020/0318353 A1 * 10/2020 DeRogatis ..... E04D 1/08

FOREIGN PATENT DOCUMENTS

FR 2142791 A * 2/1973 ..... E04D 1/2916
GB 2249112 A * 4/1992 ..... E04D 1/28
GB 2378966 A * 2/2003 ..... E04D 1/16
KR 2018017574 A * 2/2018 ..... E04D 1/20

* cited by examiner

ROOF SHINGLE TILE AND METHOD OF INSTALLING THE SAME

PRIORITY

This application claims priority to U.S. Provisional Application No. 62/825,364, filed Mar. 28, 2019, the entirety of which is incorporated herein by reference.

FIELD OF THE INVENTION

The present invention relates to roof shingles for use on, for example, a building roof deck surface, and methods of installing the same.

BACKGROUND OF THE INVENTION

Molded plastic and/or composite roof shingles for exterior roof surfaces are known in the prior art. These molded panels or shingles may be made from, for example, thermoplastic polymers, including polypropylene, polyethylene, and various mixtures and copolymers thereof.

Many prior art molded or composite shingles are generally rectangular in shape and have substantially flat top and bottom surfaces. Such shingles are often installed by securing a first horizontal row along a bottom of the roof. Such shingles are then typically secured independently to the roof deck, one shingle at a time, using fasteners inserted through an upper portion of the shingle. In such examples, successive courses of shingles may be installed overlaying the previous course by as much as 50% or more so that water or other precipitation will cascade down the roof, from one course to the next, until it is shed from the roof. Such significant overlap is necessary to not only cover the fasteners used to secure the shingles to the roof deck, but also to mitigate against any water that may be blown upwards underneath overlapping rows of shingles and ultimately onto the underlying roof deck.

A disadvantage of such existing designs is, for example, requiring such significant overlap and the wasted surface area covered by adjacent rows, thereby necessitating more shingle material than would be required if such overlap could be minimized. However, shingles utilizing less material suffer from challenges associated with, for example, the leaking concerns from wind-driven water as mentioned above, along with a risk of shingles lifting and blowing off the roof in high-wind scenarios because a significantly overlapping shingle is not present to maintain the shingle in its desired position. For example, rather than secure a lower portion of the shingle to the roof deck or the lower-vertically adjacent row, such prior art shingles often rely on the significant overlap from the upper-vertically adjacent row to prevent undesired lifting of the roof shingle in such high-wind or other similar situations.

Some prior art solutions have sought to overcome certain of the disadvantages discussed above. For example, U.S. Pat. No. 8,590,270 to Martinique proposes so-called "anchor tabs" extending from one side of such shingles that receive an additional fastener at the lower end of the shingle. Such designs have the disadvantages, however, of requiring additional fasteners, which slows installation and puts more holes in the underlying roof deck, thereby increasing the risk of undesirable water infiltration.

To overcome these and other disadvantages, the present application discloses various shingle embodiments and methods for installing the same that provide mechanisms for securing the upper portions of the shingle to the roof deck and securing the lower portions of the shingles to the lower-adjacent row of shingles, rather than the roof deck itself. Such designs advantageously allow for, among other things, draining precipitation that gathers in gutter portions of the shingles onto the weather facing surface of vertically adjacent rows of shingles, thereby maximizing the shingles' ability to withstand high winds and other stresses and minimizing risk of precipitation leaking between courses of shingles to the underlying roof deck.

SUMMARY OF THE INVENTION

In some embodiments, a roof shingle tile is provided that may a first side opposite a second side, a top edge opposite a bottom groove, a top gutter, and a side gutter. In some embodiments, the bottom groove may extend along a bottom edge of the tile that includes a bottom edge of the side gutter, and the top edge may include a tongue portion sized to fit within the bottom groove of a vertically adjacent tile. The roof shingle tile may also be configured such that the second side includes an overhang portion sized to overlap the side gutter of a horizontally adjacent tile.

It is also contemplated that the roof shingle tile may include an overhang extending from the bottom edge of the tile, and/or the top gutter may include a sloped lower portion for directing water to the side gutter when installed on a roof. In some embodiments, the top gutter may also include an end stop on the sloped lower portion opposite the side gutter. The side gutter may, in some embodiments, include one or more raised partitions forming water channels. The roof shingle may also include a notched recessed portion on a back surface of the tile for receiving, for example, all or part of the top gutter of a vertically adjacent tile. In some embodiments, the notched recessed portion may be sized such that the bottom surface of the tile and a bottom surface of the vertically adjacent tile form a substantially continuous surface.

The roof shingle tile presented herein may also be configured such that the second side includes a side edge extending substantially to and along the side gutter of the horizontally adjacent tile. In some embodiments, the side gutter may include a slope enabling the side gutter to overhang the bottom groove that extends along the bottom edge of the side gutter.

The present disclosure also teaches a method of installing a plurality of roof shingle tiles on a roof deck. In some embodiments, the method may include providing a plurality of roof shingle tiles such as, for example, those discussed herein and hereinabove. In some embodiments, the method may also include installing a first horizontal row of such tiles along all or part of a substantially lowermost portion of the roof deck, wherein installation may include installing a first tile to the roof deck, and installing a second tile horizontally adjacent the first tile, wherein the overhang of the second side of the second tile overlaps the side gutter of the first tile. The method may also include installing one or more tiles in a second horizontal row vertically adjacent the first row of tiles such that the grooves of the second-row tiles receive the tongues of the first-row tiles.

In some embodiments, the method may include installing each tile by fastening the tile to the roof deck with one or more fasteners (e.g., nails or screws or the like) inserted through an upper portion of the top gutter. The method may also include installing the tiles such that an overhang extending from the bottom edge of the second-row tiles overlaps the top gutter and top edge of the first-row tiles. The method may also include installing the tiles such that a water flow surface of the side gutter of the second-row tiles extends to the upper surface of the first-row tiles.

The method may also include the step of installing a starter strip on the roof deck, wherein the starter strip may include a tongue substantially similar to the tongue of the plurality of roof shingle tiles, and wherein the tongue of the starter strip may be received by the groove of each first-row tile. Such starter strip or installation strip may include a plurality of starter strip pieces installed adjacent one another to form a continuous starter strip. The strip may also include a fastener receiving area, and further wherein the fastener receiving area is overlapped by the first row of tiles during installation.

DETAILED DESCRIPTION OF THE PREFERRED EMBODIMENTS

Figure 1:
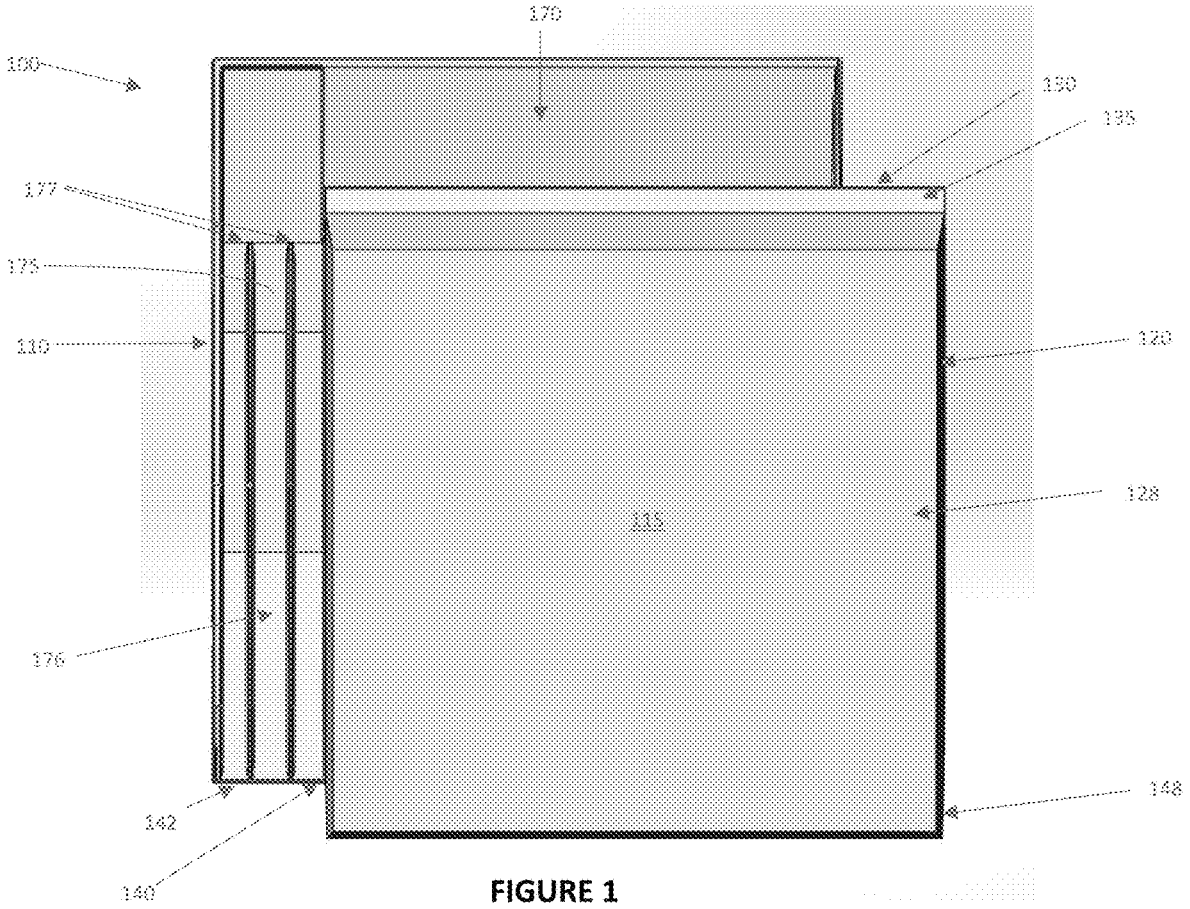
FIG. 1 is a top plan view of an exemplary roof shingle tile according to one embodiment of the present disclosure.

Specific exemplary embodiments of the inventive subject matter now will be described with reference to the accompanying drawings. This inventive subject matter may, however, be embodied in many different forms and should not be construed as limited to the embodiments set forth herein; rather, these embodiments are provided so that this disclosure will be thorough and complete, and will fully convey the scope of the inventive subject matter to those skilled in the art. In the drawings, like numbers refer to like elements. It will be understood that when an element is referred to as being "connected" or "coupled" to another element, it can be directly connected or coupled to the other element or intervening elements may be present. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the specification and the relevant art and will not be interpreted in an idealized or overly formal sense unless expressly so defined herein.

Some embodiments of the inventive subject matter arise from a realization that improved performance may be obtained from distribution transformers by using them in conjunction with a solid-state power flow controller that may be configured to be coupled in line with the transformer, e.g., between the transformer and the load in a service drop. Millions of distribution transformers are currently used in power distribution systems, and replacement of these devices with solid state or hybrid transformers would generally be prohibitively costly. In addition, replacing existing devices is also potentially wasteful, as existing devices are generally rugged and stand to provide years of additional service with relatively low maintenance. However, conventional distribution transformers typically provide no reactive power control. Such capability may be provided, however, by transformer power flow controller units configured for retrofit of existing distribution transformer installations. Such devices can be relatively low-cost, low voltage devices that are installed on the secondary side of the transformer.

Figure 2:
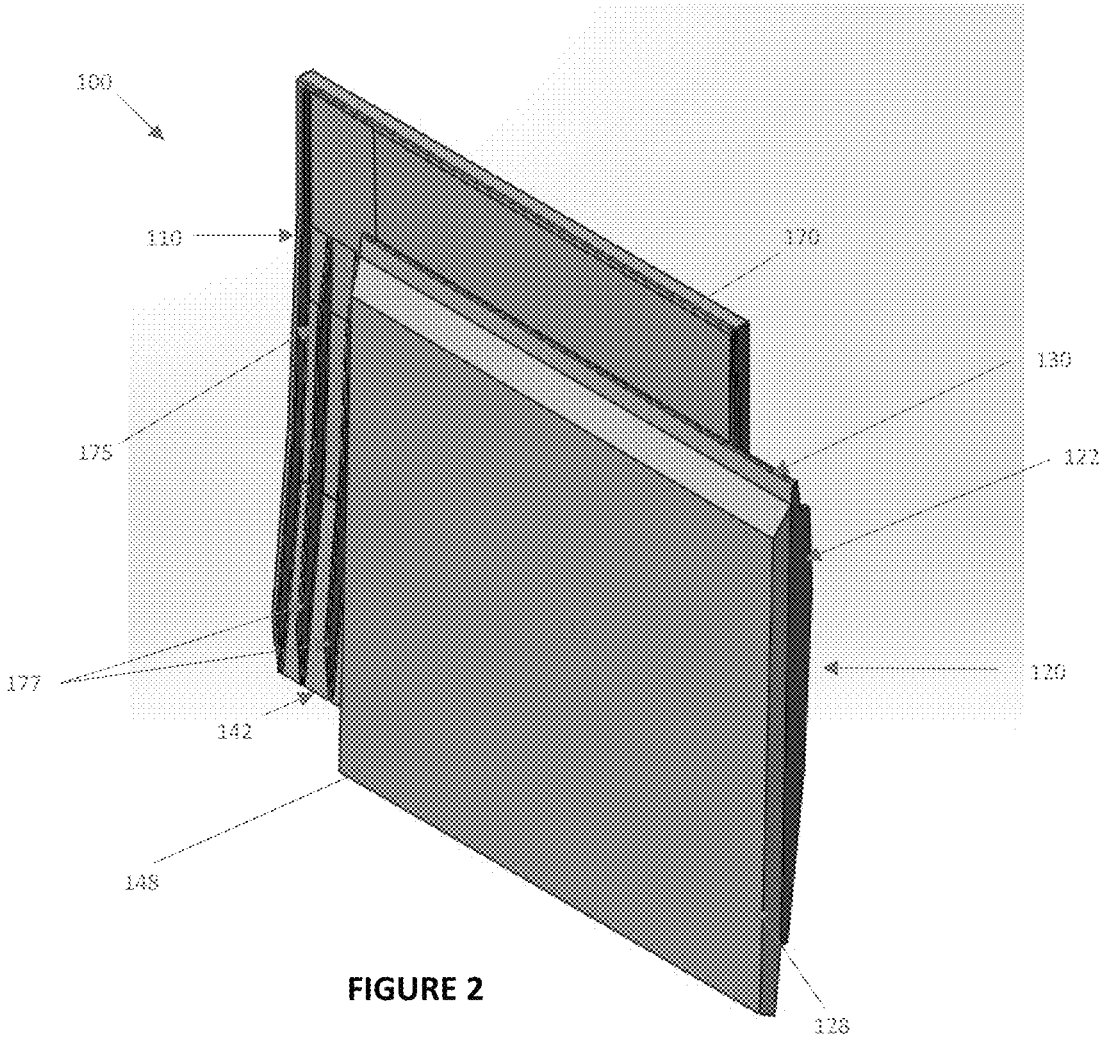
FIG. 2 is a top perspective view of an exemplary roof shingle tile according to one embodiment of the present disclosure.

Referring generally to FIGS. 1-2, a roof tile or roof shingle 100 according to one exemplary embodiment of the present disclosure is presented. In some embodiments, shingle 100 may include a first side 110 opposite a second side 120, a top edge 130 opposite a bottom edge 140, a top gutter 170, and a side gutter 175. Roof shingle tile 100 may also include an upper surface 115. Roof tile shingle 100 may also include, in some embodiments, a side overhang portion 128 sized to substantially overlap side gutter 175 of a laterally adjacent tile 100 when installed. In some embodiments, top edge 130 may include a tongue portion 135, and bottom edge 140 may include a bottom overhang portion 148.

In some embodiments, side gutter 175 may include a bottom edge 142 that may form all or a part of bottom edge 140. Side gutter 175 may also include one or more raised partitions 177. Such raised partitions 177 may advantageously channel any water flowing into or within gutter 175 (e.g., on a water flow surface 176) into a substantially vertical flow direction and mitigate against any lateral flow of water within side gutter 175. Such mitigation of lateral water flow may be advantageous when, for example, wind or other forces may drive water flowing in side gutter 175 in a lateral direction that may then be somehow forced out of the side gutter 175 and undesirably onto, for example, an underlying roof deck surface.

Roof shingle tile 100 may also include, in some embodiments, a side edge portion 122 along the second side 120 and/or overhang portion 128. In some embodiments, side edge portion 122 may extend from substantially the upper surface 115 of overhang portion 128 downwards or substantially perpendicularly downwards towards the plane of a roof-facing surface 118 (e.g., FIG. 3). In some embodiments, side edge portion 122 of a first roof shingle 100 may be shaped to substantially align with the side gutter 175 of a laterally adjacent second roof shingle 100 when installed. In such arrangements, side edge portion 122 may serve, among other things, to further block any lateral flow of water in side gutter 175 in a manner similar to raised partition(s) 177. Side edge portion 122 may also serve, in some embodiments, to aid in installation by providing, for example, a spacing guide for laterally adjacent placement of one or more roof shingles 100, support for overhang portion 128, and/or additional support and strength generally for roof shingle 100.

Figure 3:
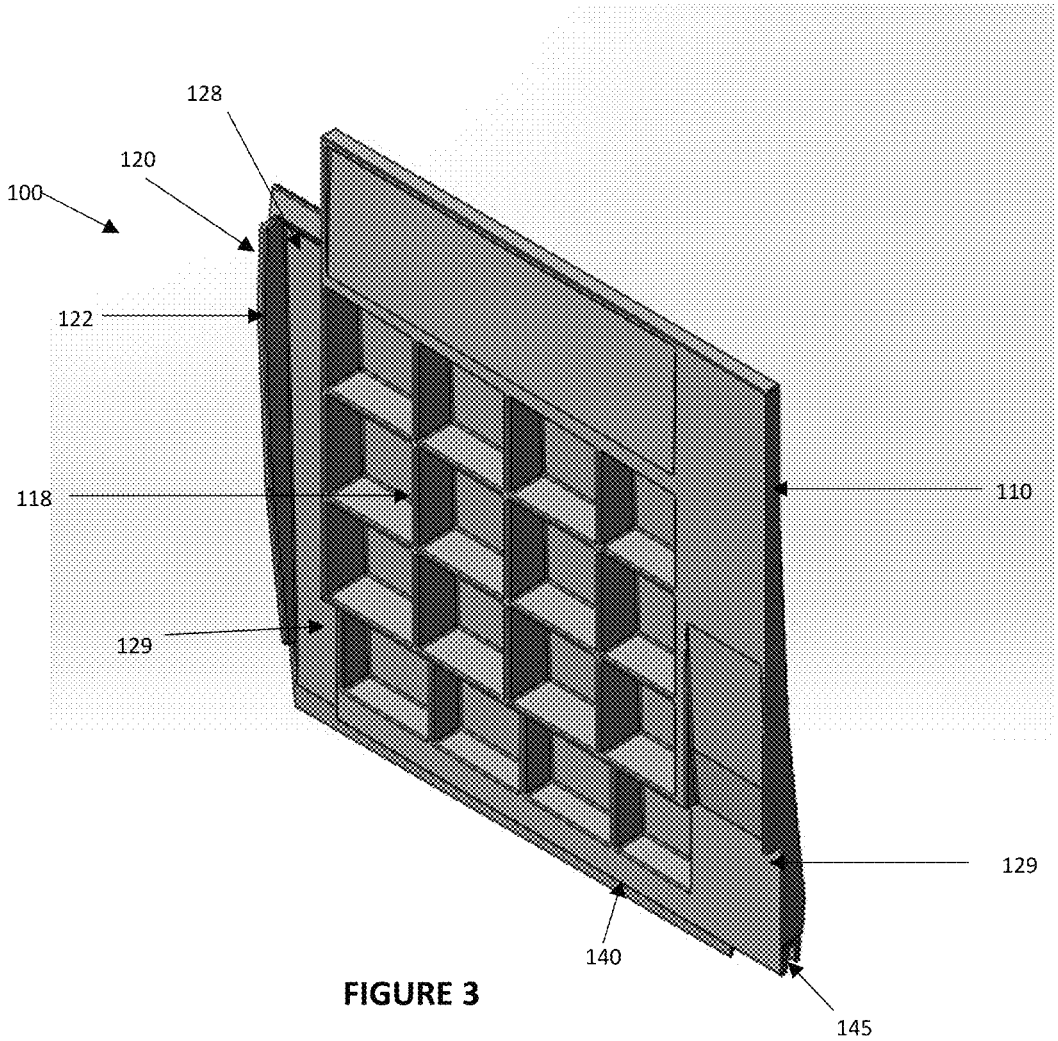
FIG. 3 is a rear perspective view of an exemplary roof shingle tile according to one embodiment of the present disclosure.
Figure 4:
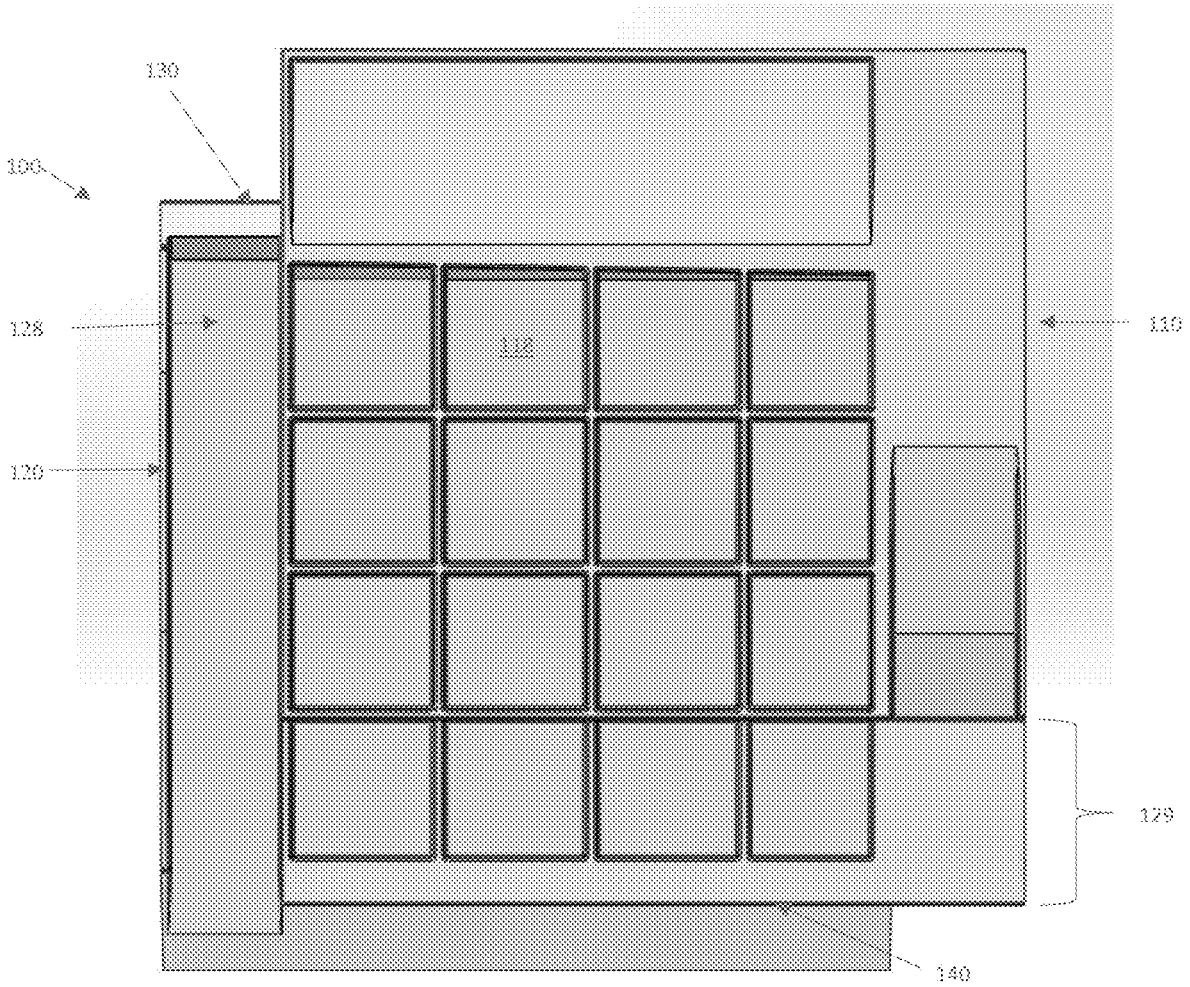
FIG. 4 is a rear plan view of an exemplary roof shingle tile according to one embodiment of the present disclosure.

Referring now to FIGS. 3 & 4, a rear or roof-facing side of roof shingle or tile 100 is presented. Roof shingle or tile 100 may include a rear facing or roof facing surface 118. In some embodiments, the bottom edge 140 and/or the side gutter bottom edge 142 may include a bottom groove 145. In some embodiments, tongue 135 may be sized and shaped to substantially fit into and otherwise mate with bottom groove 145 such that when a first roof shingle 100 is installed on a roof deck (discussed in greater detail below with reference to, for example, FIG. 7), a second roof shingle 100 may be installed on a vertically adjacent row with tongue 135 of the first shingle 100 fitting substantially within the bottom groove 145 of the second shingle 100. In such embodiments, water traveling on or within side gutter 175 (including, for example, on water flow surface 176) of the second roof shingle 100 may advantageously flow directly onto the upper surface 115 of the first roof shingle 100, thereby directing water to the shingle surface and ultimately to a roof edge and off the roof deck to be protected.

In some embodiments, roof shingle 100 may also include a notch 129 extending along a lower portion of roof-facing surface 118. Notch 129 may, in some embodiments, be sized and shaped to generally receive the top gutter 170 of a lower vertically adjacent shingle 100. In such arrangements, roof-facing surface 118 of a first shingle 100 and roof facing surface 118 of a vertically adjacent shingle 100 may form a substantially continuous and/or substantially flat surface for placement on an underlying roof deck. Notch 129 may also be useful, in some embodiments, for facilitating proper alignment and/or spacing of vertically adjacent tiles during installation.

Figure 5:
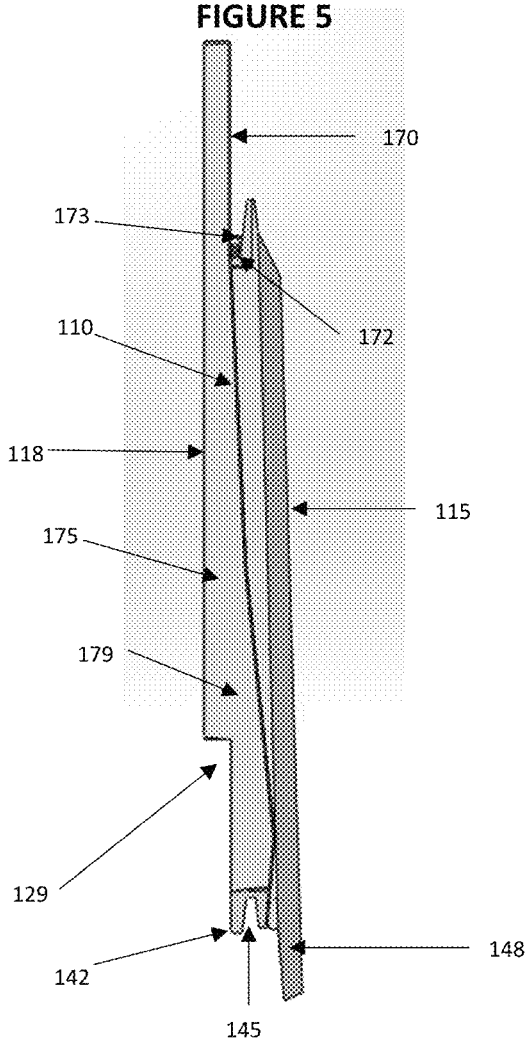
FIG. 5 is a side plan view of first side of an exemplary roof shingle tile according to one embodiment of the present disclosure.
Figure 6:
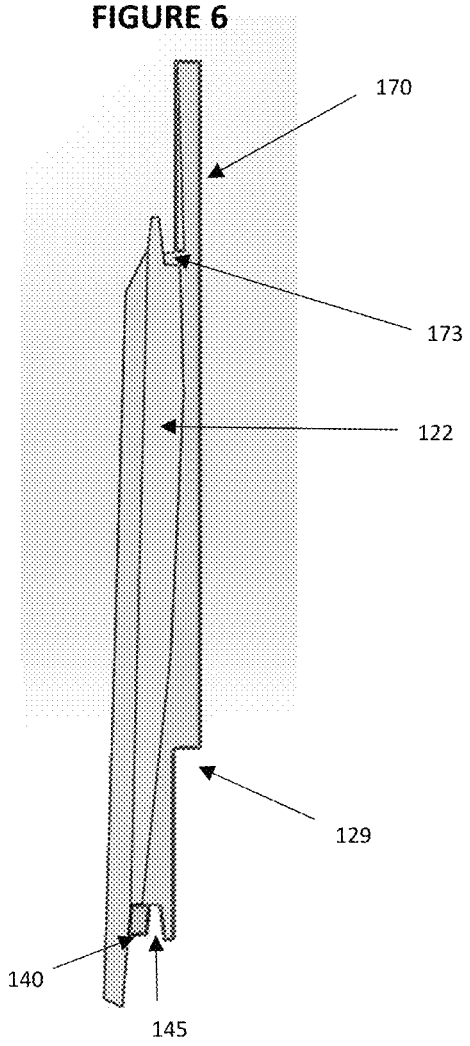
FIG. 6 is side plan view of a second side of an exemplary roof shingle tile according to one embodiment of the present disclosure.

Referring now to FIGS. 5 & 6, an exemplary side view of first side 110 of shingle 100 is presented. In some embodiments, the top gutter 170 may include a sloped lower trough 172 and a water blocking segment 173. In some embodiments, lower trough 172 may be configured to slope such that when roof shingle 100 is installed on a roof deck, any water collected or otherwise impinging on or in top gutter 170 will tend to flow toward side gutter 175 by virtue of at least the slope and the force of gravity. Any water collected in top gutter 170 and within trough 172 that is somehow directed away from side gutter 175 (for example, by a force of wind pushing water up sloped trough 172) may be blocked by water blocking segment 173 and thereby prevented from exiting top gutter 170. In some embodiments, water blocking segment 173 is disposed substantially opposite side gutter 175 substantially near, for example, second side 120.

In some embodiments, side gutter 175 may include a slope 179 to facilitate flow of water or any other matter in side gutter 175 over bottom groove 145 in bottom edge 142 of side gutter 175, and onto upper surface 115 of a vertically adjacent tile. Slope 179 may be, for example, an angle such that water may still flow freely down side gutter 175 by virtue of gravity and the slope provided by the roof deck on which shingle 100 is mounted, yet move the water flow closer to the upper surface 115 relative to roof-facing surface 118 such that water may flow freely onto upper surface 115 of a vertically adjacent shingle.

Figure 7:
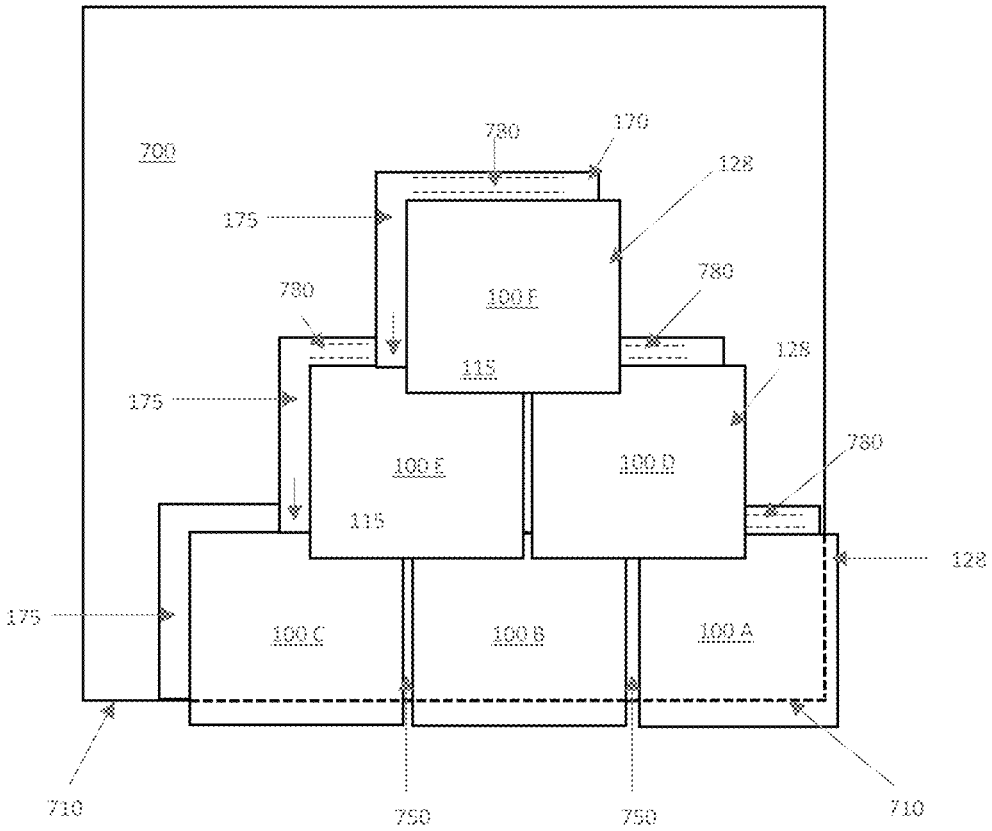
FIG. 7 is a diagram showing an exemplary installation of a plurality of roof shingle tiles according to one embodiment of the present disclosure.

Referring now to FIG. 7, an exemplary method of installing a plurality of roof tile shingles (e.g., roof tile shingle 100) on a roof deck (e.g., roof deck 700) is presented. Roof deck 700 may be any roof surface or other surface where installation of a roof or other system (e.g., siding system) to substantially prevent, among other things, infiltration of water on roof deck 700 is desired. For example, roof deck 700 may include the roof deck of a residential or other building or structure.

In preferred embodiments, roof deck 700 may include some amount of pitch such that water or other liquids/objects incident on any roof system or other system installed thereon will tend to drain or otherwise move downwards towards a roof edge 710 of the roof deck 700. For example, roof deck 700 may be pitched between 1 degree and 90 degrees, or in some embodiments, 20 degrees, and water or other matter incident on roof deck 700 or any roof or other system installed thereon will tend to flow substantially downward towards roof edge 710 where such water may be collected (for example, in a roof gutter (not depicted)) and channeled or otherwise transported advantageously away from the building structure. In some embodiments, roof deck 700 may be treated with a primary protective covering (not shown) before installation of any roofing system (e.g., a plurality of roof shingles 100).

In some embodiments, a plurality of roof shingle tiles 100 may be provided and subsequently installed in one or more successive lateral courses. In some embodiments, installation may begin with a first lateral course substantially along roof edge 710, followed by installation of one or more subsequent courses vertically adjacent the first course.

Referring to the exemplary embodiment shown in FIG. 7, a first shingle tile 100A may be installed on roof deck 700 at a lowermost portion of the roof deck 700, for example, substantially at or near roof edge 710. Roof shingle tile 100A may be secured to roof deck 700 in any appropriate manner. In one embodiment, roof shingle tile 100A may be secured to roof deck 700 using one or more fasteners such as, for example, nails or screws. In some embodiments, such fasteners may be installed through roof shingle tile 100A at a substantially upper portion of top gutter 170. For example, one or more fasteners may be installed at or within fastener region 780.

With first shingle 100A installed, a second shingle 100B may be installed laterally adjacent shingle 100A. In some embodiments, shingle 100B is installed such that overhang portion 128 of shingle 100B overlaps side gutter 175 of shingle 100A. In some embodiments, upper surface 115 of shingle 100B may contact upper surface 115 of shingle 100A, while in other embodiments, a gap 750 may remain. In some embodiments, top gutter 170 of shingles 100B and 100A may abut one another (see, for example, FIG. 9).

Roof shingle 100C may be installed in like manner, with subsequent shingles in the first lowermost row being installed and secured to the roof deck as described herein.

A vertically adjacent second row may also be installed. For example, in some embodiments, shingle 100D may be installed such that shingle 100D overlaps both shingle 100A and 100B. Shingle 100D may also be installed, in some embodiments, so as to overlap all or part of the top gutter 170 of each of shingles 100A and 100B, thereby advantageously covering any laterally abutting edges of top gutters 170 of shingles 100A and 100B.

In addition, shingle 100D may be installed with its bottom groove 145 receiving the tongues 135 of shingles 100A and 100B. The interlocking of tongue 135 and bottom groove 145 may serve to, among other things, secure the lower portion of shingle 100D to one or more of shingles 100A and 100B, and thereby oppose lifting forces acting on shingle 100D such as, for example, high winds.

Such an arrangement may also serve to facilitate water flow down the roof to the roof edge 710. For example, by having the tongue of shingle 100B insert into the bottom groove 145 of the bottom edge 142 of side gutter 175 of shingle 100D, water flowing down side gutter 175 of shingle 100D will exit side gutter 175 directly onto the upper surface 115 of shingle 100B. Similarly, water flowing down upper surface 115 of shingle 100D will flow over overhang 148 of shingle 100D and directly onto upper surface 115 of shingles 100A or 100B. As such, the risk of water flowing on, over, or otherwise incident upon roof shingle 100D reaching roof deck 700 is minimized because any water flowing on or over shingle 100D flows only onto an upper surface 115 or side gutter 175 of a lower adjacent shingle, rather than having the opportunity to become incident on, for example, a contact point between any adjacent shingles where water might infiltrate between the shingles 100 to the roof deck 700. In some embodiments, where water from an upper surface 115 of, for example, shingle 100D may flow into gap 750, the water flows directly into side gutter 175 of, for example, shingle 100A, which then flows off roof edge 710, or would flow onto the upper surface 115 of a lower vertically adjacent shingle in the manner described above.

In like manner, shingle 100E may then be installed laterally adjacent shingle 100D, and vertically adjacent to shingles 100B and 100C, with additional shingles being installed laterally along this second row as desired.

Installation may then continue laterally and vertically as needed, including in some embodiments installation of shingle 100F in a manner that overlaps both shingles 100D and 100E in a manner similar to that described hereinabove. Installation may continue both vertically and/or laterally as needed and/or desired to substantially cover the entirety of roof deck 700.

Advantageously, upon installation of the plurality of roof tile shingles 100 on roof deck 700, water incident any shingle on rows above the lowermost row may exit only to the upper surface 115 of a lower adjacent shingle or into a side gutter 175 of a lower adjacent shingle, where such water may then continue on such path of upper surfaces 115 and/or side gutters 175 all the way to the roof edge 710, minimizing and/or virtually eliminating infiltration of water to the underlying roof deck 700.

In some embodiments, an installation strip or starter strip (not shown) may be provided and installed along roof edge 710. The installation strip may, in some embodiments, include one or more of a top gutter, tongue, and upper surface portion(s) substantially similar to top gutter 170, tongue 135, and upper surface 118 of roof shingle 100. The installation strip may be substantially continuous in some embodiments, such that it is substantially similar to an upper portion of roof shingle 100 that includes top gutter 170, tongue 135 and/or a portion of upper surface 118. The installation strip may, in some embodiments, be installed in a manner substantially similar to shingle 100. For example, in some embodiments, the starter strip may be installed using any appropriate fastener and/or using any appropriate adhesive or other fastening technique known in the art. For example, the tongue of the starter strip may be disposed in the groove 145 of shingles 100A-100C, etc.

In some embodiments, the starter strip may be installed before installation of all or part of a lowermost row of shingles 100, followed by all or part of the lowermost row of roof shingles 100 installed in a manner similar to that described hereinabove. In one embodiment, the installation strip may serve to secure the lower portion of the lowermost row of roof tile shingles 100 to counteract, for example, lifting forces that may be associated with high winds, etc., as described hereinabove.

Figure 8:
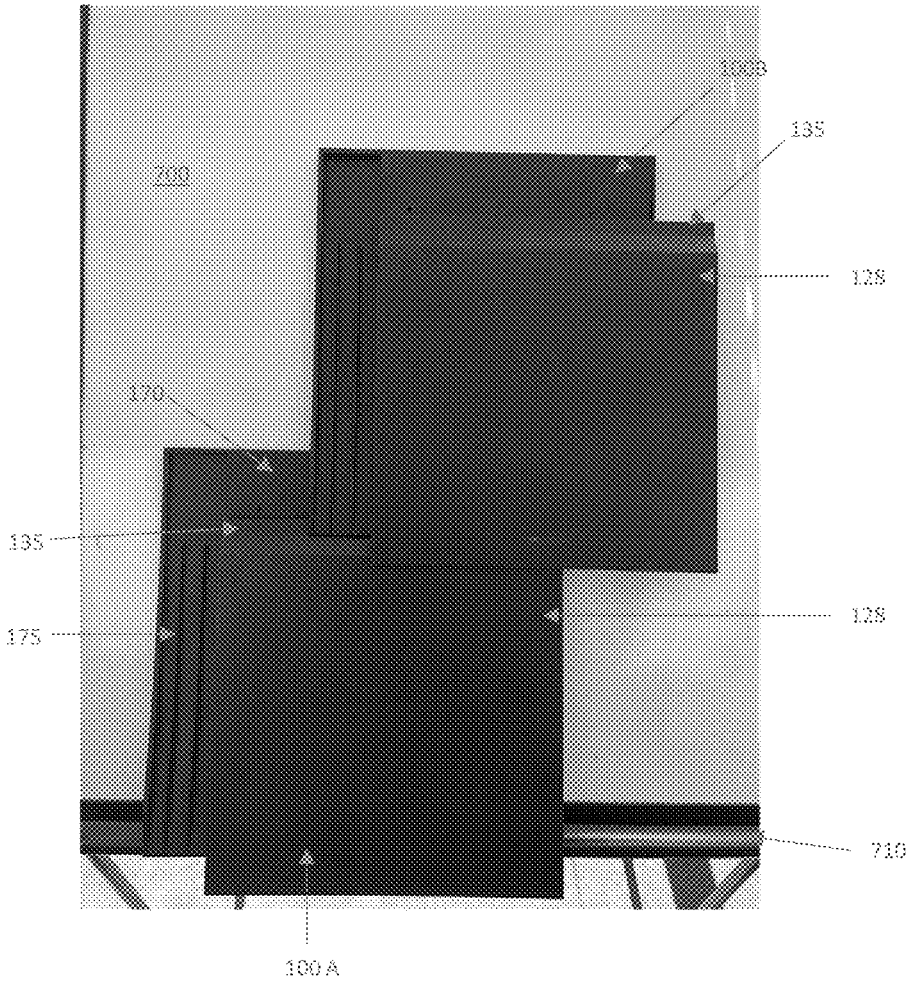
FIG. 8 is a photograph of two exemplary roof shingle tiles in an exemplary vertical configuration according to one embodiment of the present disclosure.

Referring now to FIG. 8, a photograph of exemplary embodiments of roof shingle tiles 100 is presented. The two roof shingle tiles 100A and 100B in FIG. 8 are arranged in a vertically adjacent arrangement similar to that shown and described with reference to FIG. 7. For example, tongue 135 of the lower shingle 100A is disposed within bottom groove 145 of upper shingle 100B.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

What is claimed is:

1. A roof shingle tile comprising:

a first side opposite a second side, a top edge opposite a bottom groove, a top gutter, and a side gutter;

wherein the bottom groove is formed in and extends along a bottom edge of the tile that includes a bottom edge of the side gutter;

further wherein the top edge comprises a tongue portion sized to fit within the bottom groove of a vertically adjacent tile;

and further wherein the second side comprises an overhang portion sized to overlap the side gutter of a horizontally adjacent tile.

2. The roof shingle tile of claim 1, further comprising an overhang extending from the bottom edge of the tile.

3. The roof shingle tile of claim 1, wherein the top gutter comprises a sloped lower portion for directing water to the side gutter when installed on a roof.

4. The roof shingle tile of claim 3, wherein the top gutter further comprises an end stop on the sloped lower portion opposite the side gutter.

5. The roof shingle tile of claim 1, wherein the side gutter further comprises one or more raised partitions forming water channels.

6. The roof shingle tile of claim 1 further comprising a notched recessed portion on a back surface of the tile for receiving the top gutter of a vertically adjacent tile.

7. The roof shingle tile of claim 6 wherein the notched recessed portion is sized such that the bottom surface of the tile and a bottom surface of the vertically adjacent tile form a substantially continuous surface.

8. The roof shingle tile of claim 1, wherein the second side further comprises a side edge extending substantially to and along the side gutter of the horizontally adjacent tile.

9. The roof shingle tiles of claim 1, wherein the side gutter comprises a slope enabling the side gutter to overhang the bottom groove that extends along the bottom edge of the side gutter.

10. A method of installing a plurality of roof shingle tiles on a roof deck, the method comprising:

a. providing a plurality of roof shingle tiles comprising a first side opposite a second side, a top edge opposite a bottom groove, a top gutter, and a side gutter, wherein the bottom groove is formed in and extends along a bottom edge of the tile that includes a bottom edge of the side gutter, and further wherein the top edge comprises a tongue portion sized to fit within the bottom groove of a vertically adjacent tile, and further wherein the second side comprises an overhang portion sized to overlap the side gutter of a horizontally adjacent tile b. installing a first horizontal row of tiles along all or part of a substantially lowermost portion of the roof deck, wherein installation comprises i. installing a first tile to the roof deck, and ii. installing a second tile horizontally adjacent the first tile, wherein the overhang of the second side of the second tile overlaps the side gutter of the first tile, and c. installing one or more tiles in a second horizontal row vertically adjacent the first row of tiles in accordance with the previous step, wherein the grooves of the second-row tiles receive the tongues of the first-row tiles.

11. The method of claim 10 wherein installation of each tile comprises fastening the tile to the roof deck with one or more fasteners inserted through an upper portion of the top gutter.

12. The method of claim 11 wherein the one or more fasteners comprise nails or screws.

13. The method of claim 10, wherein an overhang extending from the bottom edge of the second-row tiles overlaps the top gutter and top edge of the first-row tiles.

14. The method of claim 10, wherein a water flow surface of the side gutter of the second-row tiles extends to the upper surface of the first-row tiles.

15. The method of claim 10 further comprising the step of installing a starter strip on the roof deck, wherein the starter strip comprises a tongue sized for mating with the groove of each first-row tile.

16. The method of claim 15 wherein the starter strip comprises a plurality of starter strip pieces installed adjacent one another to form a continuous starter strip.

17. The method of claim 15 wherein the starter strip comprises a fastener receiving area, and further wherein the fastener receiving area is overlapped by the first row of tiles during installation.

18. The method of claim 10 wherein each of the one or more tiles in the second horizontal row are installed directly vertical to a corresponding first row tile.

19. The method of claim 10 wherein each of the one or more tiles in the second horizontal row are installed horizontally offset relative to a corresponding first row tile.

* * * * *